US010283240B1

(12) United States Patent
Shanbhag et al.

(10) Patent No.: US 10,283,240 B1
(45) Date of Patent: May 7, 2019

(54) ELECTRICAL CABLE

(71) Applicant: TE CONNECTIVITY CORPORATION, Berwyn, PA (US)

(72) Inventors: Megha Shanbhag, Santa Clara, CA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/969,264

(22) Filed: May 2, 2018

Related U.S. Application Data

(63) Continuation-in-part of application No. 15/925,265, filed on Mar. 19, 2018.

(51) Int. Cl.

| | |
|---|---|
| ***H01B 7/00*** | (2006.01) |
| ***H01B 11/18*** | (2006.01) |
| ***H01B 1/22*** | (2006.01) |
| ***H01B 7/02*** | (2006.01) |
| ***H01B 11/20*** | (2006.01) |
| ***H01B 11/00*** | (2006.01) |

(52) U.S. Cl.
CPC ..... *H01B 11/1895* (2013.01); *H01B 1/22* (2013.01); *H01B 7/0208* (2013.01); *H01B 11/002* (2013.01); *H01B 11/1891* (2013.01); *H01B 11/20* (2013.01)

(58) Field of Classification Search
CPC ... H01B 7/02; H01B 7/04; H01B 9/02; H01B 9/04; H01B 11/02; H01B 11/04
USPC ..... 174/36, 102 R, 102 SP, 110 R, 113 R, 174/117 R
See application file for complete search history.

(56) References Cited

U.S. PATENT DOCUMENTS

| | | | | |
|---|---|---|---|---|
| 3,340,353 A | | 9/1967 | Mildner | |
| 3,439,111 A | * | 4/1969 | Miracle ..... | H01B 11/1016 174/107 |
| 4,221,926 A | | 9/1980 | Schneider | |

(Continued)

FOREIGN PATENT DOCUMENTS

| | | |
|---|---|---|
| CN | 201327733 | 10/2009 |
| CN | 201359878 | 12/2009 |

(Continued)

OTHER PUBLICATIONS

Co-pending U.S. Appl. No. 15/925,243, filed Mar. 19, 2018.

(Continued)

*Primary Examiner* — William H Mayo, III

(57) ABSTRACT

An electrical cable includes a conductor assembly having a first conductor, a second conductor, a first insulator surrounding the first conductor and a second insulator surrounding the second conductor. The first insulator has a first thickness between the first conductor and an outer surface. The second insulator has a second thickness between the second conductor and an outer surface. The first thickness is greater than the second thickness. A cable shield is wrapped around the conductor assembly and engages the outer surface of the first insulator along a first segment and engaging the outer surface of the second insulator along a second segment. The cable shield has an inner edge and a flap covering the inner edge. The cable shield forms a void at the inner edge located closer to the first conductor than the second conductor.

20 Claims, 2 Drawing Sheets

(56) References Cited

U.S. PATENT DOCUMENTS

| | | | | |
|---|---|---|---|---|
| 4,596,897 | A | 6/1986 | Grunt | |
| 4,644,092 | A | 2/1987 | Gentry | |
| 5,142,100 | A | 8/1992 | Vaupotic | |
| 5,329,064 | A | 7/1994 | Tash et al. | |
| 5,349,133 | A | 9/1994 | Rogers | |
| 5,619,016 | A * | 4/1997 | Newmoyer | H01B 11/02 174/113 R |
| 6,010,788 | A | 1/2000 | Kebabjian et al. | |
| 6,403,887 | B1 * | 6/2002 | Kebabjian | H01B 11/002 174/110 R |
| 6,504,379 | B1 | 1/2003 | Jackson | |
| 6,677,518 | B2 | 1/2004 | Hirakawa et al. | |
| 7,314,998 | B2 | 1/2008 | Amato et al. | |
| 7,790,981 | B2 | 9/2010 | Vaupotic et al. | |
| 7,827,678 | B2 | 11/2010 | Dion et al. | |
| 7,999,185 | B2 * | 8/2011 | Cases | H01B 11/203 174/113 R |
| 8,378,217 | B2 | 2/2013 | Sugiyama et al. | |
| 8,381,397 | B2 | 2/2013 | Dion et al. | |
| 8,440,910 | B2 * | 5/2013 | Nonen | H01B 11/203 174/113 R |
| 8,546,691 | B2 * | 10/2013 | Watanabe | H01B 11/18 174/102 R |
| 8,552,291 | B2 * | 10/2013 | Lingambudi | H01B 11/203 174/110 R |
| 8,575,488 | B2 | 11/2013 | Sugiyama et al. | |
| 8,674,228 | B2 | 3/2014 | Dion et al. | |
| 8,866,010 | B2 | 10/2014 | Nonen et al. | |
| 8,981,216 | B2 * | 3/2015 | Grant | H01B 11/06 174/113 R |
| 8,993,883 | B2 | 3/2015 | Kumakura et al. | |
| 9,064,621 | B2 | 6/2015 | Kodama et al. | |
| 9,117,572 | B2 | 8/2015 | Fukasaku | |
| 9,123,452 | B2 | 9/2015 | Sugiyama et al. | |
| 9,123,457 | B2 | 9/2015 | Kaga et al. | |
| 9,136,042 | B2 * | 9/2015 | Sugiyama | H01B 11/00 |
| 9,142,333 | B2 * | 9/2015 | Kaga | H01B 13/142 |
| 9,159,472 | B2 | 10/2015 | Nordin et al. | |
| 9,214,260 | B2 | 12/2015 | Ishikawa et al. | |
| 9,299,481 | B2 * | 3/2016 | Ishikawa | H01B 11/002 |
| 9,349,508 | B2 * | 5/2016 | Nonen | H01B 11/20 |
| 9,350,571 | B2 | 5/2016 | Watanabe et al. | |
| 9,466,408 | B2 | 10/2016 | Sugiyama | |
| 9,484,127 | B2 | 11/2016 | Sugiyama et al. | |
| 9,496,071 | B2 | 11/2016 | Nagagashi | |
| 9,548,143 | B2 | 1/2017 | Sugiyama et al. | |
| 9,583,235 | B2 | 2/2017 | Nonen et al. | |
| 9,660,318 | B2 | 5/2017 | Sugiyama et al. | |
| 2003/0150633 | A1 * | 8/2003 | Hirakawa | H01B 11/002 174/36 |
| 2006/0254801 | A1 | 11/2006 | Stevens | |
| 2010/0307790 | A1 | 12/2010 | Okano | |
| 2011/0100682 | A1 * | 5/2011 | Nonen | H01B 11/203 174/254 |
| 2011/0127062 | A1 | 6/2011 | Cases et al. | |
| 2012/0024566 | A1 | 2/2012 | Shimosawa et al. | |
| 2012/0080211 | A1 | 4/2012 | Brown et al. | |
| 2012/0152589 | A1 * | 6/2012 | Kumakura | H01B 11/183 174/109 |
| 2012/0227998 | A1 * | 9/2012 | Lindstrom | H01B 11/1025 174/103 |
| 2013/0175081 | A1 * | 7/2013 | Watanabe | H01B 11/1834 174/363 |
| 2013/0333913 | A1 * | 12/2013 | Nonen | H01B 11/085 174/34 |
| 2014/0048302 | A1 * | 2/2014 | Nonen | H01B 11/02 174/34 |
| 2014/0102783 | A1 | 4/2014 | Nagahashi et al. | |
| 2014/0305676 | A1 | 10/2014 | Sugiyama et al. | |
| 2015/0000954 | A1 * | 1/2015 | Nonen | H01B 11/20 174/103 |
| 2015/0255928 | A1 | 9/2015 | Liptak et al. | |
| 2016/0111187 | A1 | 4/2016 | Kodama | |
| 2016/0155540 | A1 | 6/2016 | Matsuda et al. | |
| 2016/0300642 | A1 * | 10/2016 | Kodama | H01B 3/307 |
| 2016/0343474 | A1 | 11/2016 | Nichols | |
| 2016/0372235 | A1 | 12/2016 | Sugiyama et al. | |
| 2017/0103830 | A1 | 4/2017 | Dettmer et al. | |
| 2018/0096755 | A1 | 4/2018 | Tsujino et al. | |

FOREIGN PATENT DOCUMENTS

| | | |
|---|---|---|
| CN | 102231303 | 11/2011 |
| CN | 203931605 | 11/2014 |
| CN | 105741965 | 7/2016 |
| JP | 2000040423 | 2/2000 |
| JP | 2001093357 | 4/2001 |
| JP | 2012009321 | 1/2012 |
| JP | 2012238468 | 12/2012 |
| JP | 2013038082 | 2/2013 |
| JP | 2013258009 | 12/2013 |
| JP | 2014038802 | 2/2014 |
| JP | 2014078339 | 5/2014 |
| JP | 2014099404 | 5/2014 |
| JP | 2014142247 | 8/2014 |
| JP | 2014154490 | 8/2014 |
| JP | 2014157709 | 8/2014 |
| JP | 2015076138 | 4/2015 |
| JP | 2015146298 | 8/2015 |
| JP | 2015204195 | 11/2015 |
| JP | 2015230836 | 12/2015 |
| JP | 2016015255 | 1/2016 |
| JP | 2016027547 | 2/2016 |
| JP | 2016072007 | 5/2016 |
| JP | 2016072196 | 5/2016 |
| JP | 2016110960 | 6/2016 |
| JP | 2016213111 | 12/2016 |
| WO | 96041351 | 12/1996 |

OTHER PUBLICATIONS

Co-pending U.S. Appl. No. 15/925,265, filed Mar. 19, 2018.
Co-pending U.S. Appl. No. 15/952,690, filed Apr. 13, 2018.
Co-pending U.S. Appl. No. 16/159,003, filed Oct. 12, 2018.
Co-pending U.S. Appl. No. 16/159,053, filed Oct. 12, 2018.

* cited by examiner

ELECTRICAL CABLE

CROSS REFERENCE TO RELATED APPLICATIONS

This application is a continuation-in-part application of and claims benefit to U.S. application Ser. No. 15/925,265, filed Mar. 19, 2018, titled "ELECTRICAL CABLE", the subject matter of which is herein incorporated by reference in its entirety.

BACKGROUND OF THE INVENTION

The subject matter herein relates generally to electrical cables that provide shielding around signal conductors.

Shielded electrical cables are used in high-speed data transmission applications in which electromagnetic interference (EMI) and/or radio frequency interference (RFI) are concerns. Electrical signals routed through shielded cables may radiate less EMI/RFI emissions to the external environment than electrical signals routed through non-shielded cables. In addition, the electrical signals being transmitted through the shielded cables may be better protected against interference from environmental sources of EMI/RFI than signals through non-shielded cables.

Shielded electrical cables are typically provided with a cable shield formed by a tape wrapped around the conductor assembly. Signal conductors are typically arranged in pairs conveying differential signals. The signal conductors are surrounded by an insulator and the cable shield is wrapped around the insulator. However, where the cable shield overlaps itself, a void is created that is filled with air, which has a different dielectric constant than the material of the insulator and shifts the cable shield farther from the signal conductor. The void affects the electrical performance of the conductors in the electrical cable by changing the dielectric constant of the material near one of the conductors compared to the other of the conductors within the differential pair, leading the electrical skew.

A need remains for an electrical cable that improves signal performance.

BRIEF DESCRIPTION OF THE INVENTION

In an embodiment, an electrical cable is provided including a conductor assembly having a first conductor, a second conductor, a first insulator surrounding the first conductor and a second insulator surrounding the second conductor. The first and second conductors carry differential signals. The first insulator has an outer surface and a first thickness between the first conductor and the outer surface of the first insulator. The second insulator has an outer surface and a second thickness between the second conductor and the outer surface of the second insulator. The first thickness is greater than the second thickness. A cable shield is wrapped around the conductor assembly and engages the outer surface of the first insulator along a first segment and engaging the outer surface of the second insulator along a second segment. The cable shield has an inner edge and a flap covering the inner edge. The cable shield forms a void at the inner edge located closer to the first conductor than the second conductor.

In another embodiment, an electrical cable is provided including a conductor assembly having a first conductor, a second conductor, and an insulator structure surrounding the first conductor and the second conductor. The first and second conductors carry differential signals, the insulator structure having an outer surface. A cable shield is wrapped around the conductor assembly and engages the outer surface of the insulator structure. The cable shield has an inner edge and a flap covering the inner edge. The cable shield forms a void at the inner edge located closer to the first conductor than the second conductor. The first conductor is located a first shield distance from the cable shield and the second conductor is located a second shield distance from the cable shield. The first shield distance is greater than the second shield distance.

In a further embodiment, an electrical cable is provided including a conductor assembly having a first conductor, a second conductor, a first insulator surrounding the first conductor and a second insulator surrounding the second conductor. The first and second conductors carry differential signals. The first insulator has an outer surface and a first diameter at the outer surface. The second insulator has an outer surface and a second diameter at the outer surface. The first diameter is larger than the second diameter. A cable shield is wrapped around the conductor assembly and engages the outer surface of the insulator structure. The cable shield has an inner edge and a flap covering the inner edge forming a void at the inner edge located closer to the first conductor than the second conductor. The void has a volume creating a decrease in capacitance of the first conductor compared to the second conductor. The first insulator is sized larger than the second insulator creating an increase in inductance in the first conductor compared to the second conductor. The increase in inductance due to the larger first diameter is proportional to the decrease in capacitance due to the void to balance skew effects.

DETAILED DESCRIPTION OF THE INVENTION

Figure 1:
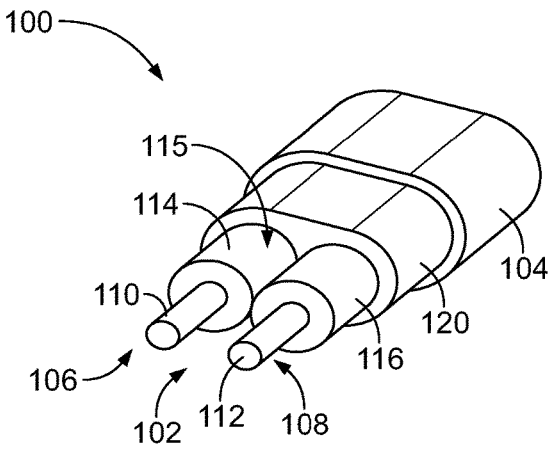
FIG. 1 is a perspective view of a portion of an electrical cable formed in accordance with an embodiment.

FIG. 1 is a perspective view of a portion of an electrical cable 100 formed in accordance with an embodiment. The electrical cable 100 may be used for high speed data transmission between two electrical devices, such as electrical switches, routers, and/or host bus adapters. For example, the electrical cable 100 may be configured to transmit data signals at speeds of at least 10 gigabits per second (Gbps), which is required by numerous signaling standards, such as the enhanced small form-factor pluggable (SFP+) standard. For example, the electrical cable 100 may be used to provide a signal path between high speed connectors that transmit data signals at high speeds.

The electrical cable 100 includes a conductor assembly 102. The conductor assembly 102 is held within an outer jacket 104 of the electrical cable 100. The outer jacket 104 surrounds the conductor assembly 102 along a length of the conductor assembly 102. In FIG. 1, the conductor assembly 102 is shown protruding from the outer jacket 104 for clarity in order to illustrate the various components of the conductor assembly 102 that would otherwise be obstructed by the outer jacket 104. It is recognized, however, that the outer jacket 104 may be stripped away from the conductor assembly 102 at a distal end 106 of the cable 100, for example, to allow for the conductor assembly 102 to terminate to an electrical connector, a printed circuit board, or the like. In an alternative embodiment, the electrical cable 100 does not include the outer jacket 104.

The conductor assembly 102 includes inner conductors arranged in a pair 108 that are configured to convey data signals. In an exemplary embodiment, the pair 108 of conductors defines a differential pair conveying differential signals. The conductor assembly 102 includes a first conductor 110 and a second conductor 112. In various embodiments, the conductor assembly 102 is a twin-axial differential pair conductor assembly. In an exemplary embodiment, the conductor assembly 102 includes an insulator structure 115 surrounding the conductors 110, 112. In various embodiments, the insulator structure 115 is a monolithic, unitary insulator (FIG. 3) surrounding both conductors 110, 112. In other various embodiments, as in the illustrated embodiment of FIG. 1, the conductor assembly 102 includes a first insulator 114 and a second insulator 116 surrounding the first and second conductors 110, 112, respectively. The first and second insulators 114, 116 are separate and discrete insulators sandwiched together within the cable core of the electrical cable 100. The first and second insulators 112, 114 thus define a multi-piece insulator structure 115. The conductor assembly 102 includes a cable shield 120 surrounding the conductor assembly 102 and providing electrical shielding for the conductors 110, 112.

The conductors 110, 112 extend longitudinally along the length of the cable 100. The conductors 110, 112 are formed of a conductive material, for example a metal material, such as copper, aluminum, silver, or the like. Each conductor 110, 112 may be a solid conductor or alternatively may be composed of a combination of multiple strands wound together. The conductors 110, 112 extend generally parallel to one another along the length of the electrical cable 100.

The first and second insulators 114, 116 surround and engage outer perimeters of the corresponding first and second conductors 110, 112. As used herein, two components "engage" or are in "engagement" when there is direct physical contact between the two components. The insulators 114, 116 are formed of a dielectric material, for example one or more plastic materials, such as polyethylene, polypropylene, polytetrafluoroethylene, or the like. The insulators 114, 116 may be formed directly to the inner conductors 110, 112 by a molding process, such as extrusion, overmolding, injection molding, or the like. The insulators 114, 116 extend between the conductors 110, 112 and the cable shield 120. The insulators 114, 116 separate or space apart the conductors 110, 112 from one another and separate or space apart the conductors 110, 112 from the cable shield 120. The insulators 114, 116 maintain separation and positioning of the conductors 110, 112 along the length of the electrical cable 100. The size and/or shape of the conductors 110, 112, the size and/or shape of the insulators 114, 116, and the relative positions of the conductors 110, 112 and the insulators 114, 116 may be modified or selected in order to attain a particular impedance for the electrical cable 100. In an exemplary embodiment, the conductors 110, 112 and/or the insulators 114, 116 may be asymmetrical to compensate for skew imbalance induced by the cable shield 120 on either or both of the conductors 110, 112. For example, in an exemplary embodiment, the first conductor 110 has a smaller diameter than the second conductor 112 to increase inductance in the first conductor 110, which compensates for the decrease in capacitance in the first conductor 110 due to the void near the first conductor formed by wrapping the longitudinal cable shield 120 around the cable core. In other various embodiments, the first insulator 114 has a larger diameter than the second insulator 116 to increase inductance in the first conductor 110, which compensates for the decrease in capacitance in the first conductor 110 due to the void near the first conductor 110 formed by wrapping the longitudinal cable shield 120 around the cable core.

The cable shield 120 engages and surrounds outer perimeters of the insulators 114, 116. In an exemplary embodiment, the cable shield 120 is wrapped around the insulators 114, 116. For example, in an exemplary embodiment, the cable shield 120 is formed as a longitudinal wrap, otherwise known as a cigarette wrap, where the seam of the wrap extends longitudinally along the electrical cable 100. The seam, and thus the void created by the seam, is in the same location along the length of the electrical cable 100. The cable shield 120 is formed, at least in part, of a conductive material. In an exemplary embodiment, the cable shield 120 is a tape configured to be wrapped around the cable core. For example, the cable shield 120 may include a multi-layer tape having a conductive layer and an insulating layer, such as a backing layer. The conductive layer and the backing layer may be secured together by adhesive. An adhesive layer may be provided along the interior of the cable shield 120 to secure the cable shield 120 to the insulator structure 115 and/or itself. The conductive layer may be a conductive foil or another type of conductive layer. The insulating layer may be a polyethylene terephthalate (PET) film, or similar type of film. The conductive layer provides both an impedance reference layer and electrical shielding for the first and second conductors 110, 112 from external sources of EMI/RFI interference and/or to block cross-talk between other conductor assemblies 102 or electrical cables 100. In an exemplary embodiment, the electrical cable 100 includes a wrap (not shown) or another layer around the cable shield 120 that holds the cable shield 120 on the insulators 114, 116. For example, the electrical cable 100 may include a helical wrap. The wrap may be a heat shrink wrap. The wrap is located inside the outer jacket 104.

The outer jacket 104 surrounds and engages the outer perimeter of the cable shield 120. In the illustrated embodiment, the outer jacket 104 engages the cable shield 120 along substantially the entire periphery of the cable shield 120. The outer jacket 104 is formed of at least one dielectric material, such as one or more plastics (for example, vinyl, polyvinyl chloride (PVC), acrylonitrile butadiene styrene (ABS), or the like). The outer jacket 104 is non-conductive, and is used to insulate the cable shield 120 from objects outside of the electrical cable 100. The outer jacket 104 also protects the cable shield 120 and the other internal components of the electrical cable 100 from mechanical forces, contaminants, and elements (such as fluctuating temperature and humidity). Optionally, the outer jacket 104 may be extruded or otherwise molded around the cable shield 120. Alternatively, the outer jacket 104 may be wrapped around the cable shield 120 or heat shrunk around the cable shield 120.

Figure 2:
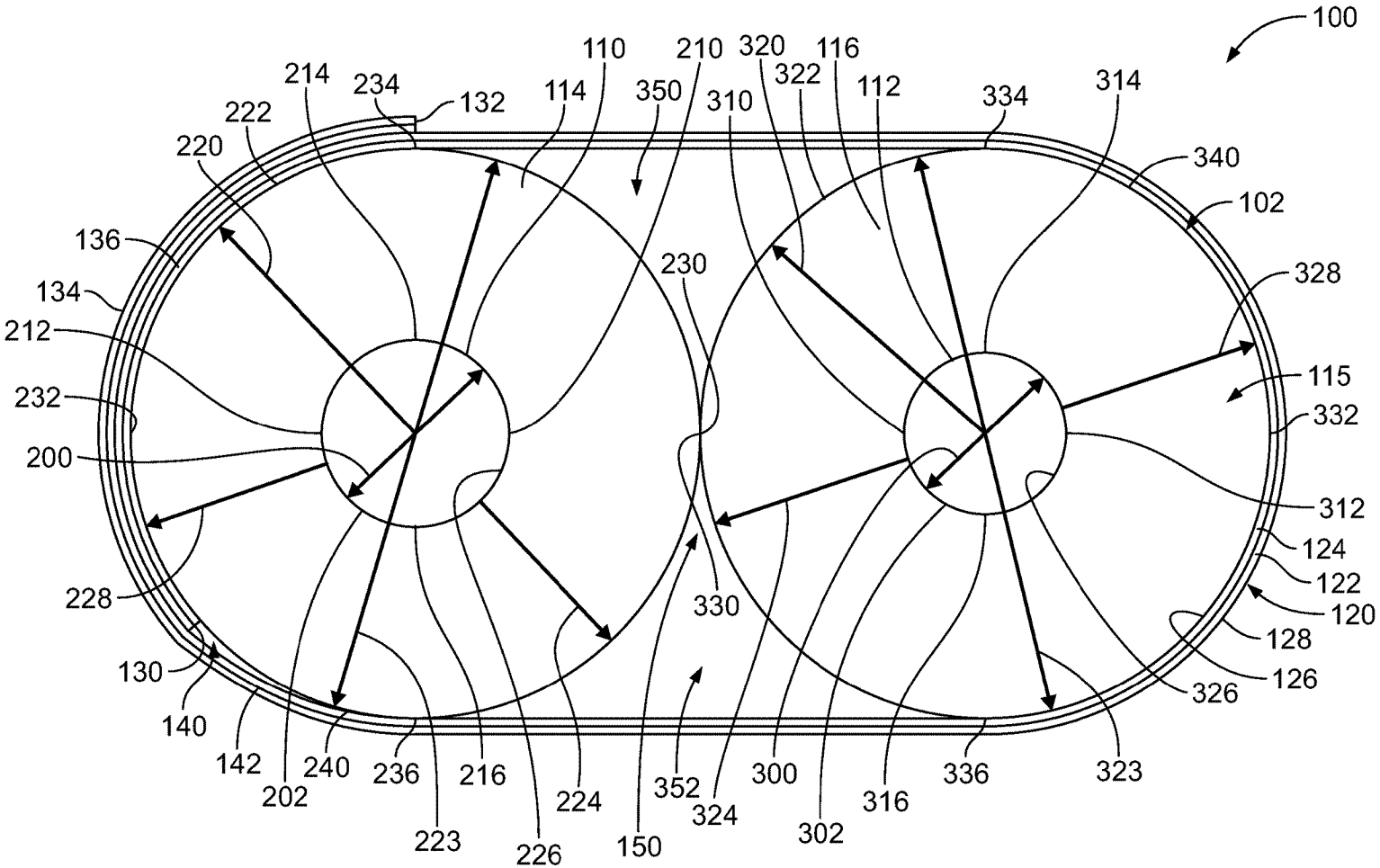
FIG. 2 is a cross-sectional view of the conductor assembly in accordance with an exemplary embodiment.

FIG. 2 is a cross-sectional view of the conductor assembly 102 in accordance with an exemplary embodiment. The cable shield 120 is wrapped around the first and second insulators 114, 116 in the cable core. The cable shield 120 includes a conductive layer 122 and an insulating layer 124. In the illustrated embodiment, the insulating layer 124 is provided on an interior 126 of the cable shield 120 and the conductive layer 122 is provided on an exterior 128 of the cable shield 120; however, the conductive layer 122 may be provided on the interior of the cable shield in alternative embodiments.

The cable shield 120 includes an inner edge 130 and an outer edge 132. When the cable shield 120 is wrapped around the cable core, a flap 134 of the cable shield 120 overlaps the inner edge 130 and a segment 136 of the cable shield 120 on a seam side of the electrical cable 100. The overlapping portion of the cable shield 120 forms a seam along the seam side of the electrical cable 100. The interior 126 of the flap 134 may be secured to the exterior 128 of the segment 136 at the seam, such as using adhesive. The interior 126 of portions of the cable shield 120 may be secured directly to the first and second insulators 114, 116, such as using adhesive. In addition, or in lieu of adhesive, the cable shield 120 may be held in place around the cable core by an additional helical wrap, such as a heat shrink wrap. When the cable shield 120 is wrapped over itself to form the flap 134, a void 140 is created at the seam side of the electrical cable 100. In various embodiments, the void 140 is a pocket of air defined between the interior 126 of an elevated segment 142 of the cable shield 120 and one of the insulators, such as the first insulator 114. The void 140 may be referred to hereinafter as an air void 140. However, in other various embodiments, the void 140 may be filled with another material, such as adhesive or other dielectric material. The elevated segment 142 is elevated or lifted off of the first insulator 114 to allow the flap 134 to clear the inner edge 130. The elevated segment 142 moves the cable shield 120 farther from the first conductor 110, which affects the inductance and capacitance of the first conductor 110. The volume of the air (or other dielectric material) in the void 140 affects the electrical characteristics of the nearest conductor, such as the first conductor 110, by changing the effective dielectric constant of the dielectric material between the first conductor 110 and the conductive layer 122 of the cable shield 120. The air in the void 140 and/or moving the elevated segment 142 farther from the first conductor 110 decreases the capacitance to ground of the first conductor 110, which speeds up the signals in the first conductor 110, leading to a skew imbalance for the electrical cable 100 compared to the second conductor 112. While it may be desirable to reduce the volume of the void 140, the presence of the void 140 is inevitable when the electrical cable 100 is assembled due to the flap 134 overlapping the segment 136.

The air in the void 140 leads to a skew imbalance for the first conductor 110 by changing the effective dielectric constant of the dielectric material around the first conductor 110, compared to the second conductor 112. For example, signals transmitted by the first conductor 110 may be transmitted faster than the signals transmitted by the second conductor 112, leading to skew in the differential pair. Signal delay in the conductor is a function of inductance and capacitance of the conductor. Delay is the square root of inductance times capacitance. The speed of the signal in the conductor is the inverse of the delay, and is thus also a function of inductance and capacitance. Capacitance of the first conductor 110 is lowered by the void 140 due to its change on the effective dielectric constant. Capacitance of the first conductor 110 is lowered because the cable shield 120 along the void 140 (for example, the flap 134) is shifted farther away from the first conductor 110 along the void 140.

In various embodiments, decrease in capacitance of the first conductor 110, due to the void 140, is compensated with a proportional increase in inductance in the first conductor 110 to keep the delay similar to the signal in the second conductor 112 and thus mitigate skew imbalance. In an exemplary embodiment, the inductance of the first conductor 110 is increased by decreasing the diameter of the first conductor 110 compared to the second conductor 112. In other various embodiments, decrease in capacitance of the first conductor 110, due to the void 140, is compensated with a proportional increase in inductance in the first conductor 110 to keep the delay similar to the signal in the second conductor 112 and thus mitigate skew imbalance. In an exemplary embodiment, the inductance of the first conductor 110 is increased by increasing the diameter of the first insulator 114 compared to the second insulator 116. The inductance of the first conductor 110 may be increased by increasing the shield distance between the first conductor 110 compared to the second conductor 112, such as by moving the cable shield further from the first conductor 110 by increasing the thickness of the first insulator 114.

In FIG. 2, the conductor assembly 102 is provided with the first and second insulators 114, 116 of the insulator structure 115 being separate insulators engaging and fully surrounding the first and second conductors 110, 112, respectively. The first insulator 114 may be molded, extruded or otherwise formed with the first conductor 110 and the second insulator 116 may be molded, extruded or otherwise formed with the second conductor 112 separately from the first insulator 114 and the first conductor 110. The first and second insulators 114, 116 engage one another along a seam 150 that is located between the conductors 110, 112. In an example, the conductor assembly 102 shown in FIG. 2 may be formed by initially applying the first and second insulators 114, 116 to the respective first and second conductors 110, 112, independently, to form two insulated wires. The insulators 114, 116 of the two insulated wires are then pressed into contact with one another, and optionally bonded to one another, at the seam 150, and subsequently collectively surrounded by the cable shield 120. In various embodiments, the outer perimeters of the insulators 114, 116 are identical. For example, the first and second insulators 114, 116 have equal diameters. However, in alternative embodiments, the insulators 114, 116 may be asymmetrical, such as having different diameters. The outer perimeters of the insulators 114, 116 may have a generally lemniscate or figure-eight shape, due to the combination of the two circular or elliptical insulators 114, 116.

In an exemplary embodiment, the first conductor 110 has a first conductor outer surface 202 having a circular cross-section having a first diameter 200. The first conductor 110 has an inner end 210 facing the second conductor 112 and an outer end 212 opposite the inner end 210. The first conductor 110 has a first side 214 (for example, a top side) and a second side 216 (for example, a bottom side) opposite the first side 214. The first and second sides 214, 216 are equidistant from the inner and outer ends 210, 212.

In an exemplary embodiment, the first insulator 114 has a circular cross-section surrounding the first conductor 110. The first insulator 114 has a first radius 220 to a first insulator outer surface 222 and a first diameter 223. The first insulator 114 has a first thickness 224 between the first conductor 110 at a first insulator inner surface 226 and the first insulator outer surface 222. The first thickness 224 defines a first distance or shield distance 228 between the first conductor 110 and the cable shield 120. The first insulator inner surface 226 engages the first conductor outer surface 202. The first insulator outer surface 222 engages the second insulator 116 at the seam 150. The first insulator 114 has an inner end 230 facing the second insulator 116 and an outer end 232 opposite the inner end 230. The first insulator 114 has a first side 234 (for example, a top side) and a second side 236 (for example, a bottom side) opposite the first side 234. The first and second sides 234, 236 are equidistant from the inner and outer ends 230, 232.

The cable shield 120 engages the first insulator outer surface 222 along a first segment 240. For example, the first segment 240 may extend from approximately the first side 234 to approximately the second side 236 while passing the outer end 232. The first segment 240 may encompass approximately half of the outer circumference of the first insulator outer surface 222. The shield distance 228 between the cable shield 120 and the first conductor 110 is defined by the thickness 224 of the first insulator 114 between the inner surface 226 and the outer surface 222. The shield distance 228 affects the electrical characteristics of the signals transmitted by the first conductor 110. For example, the shield distance 228 affects the inductance and the capacitance of the first conductor 110, which affects the delay or skew of the signal, the insertion loss of the signal, the return loss of the signal, and the like. In an exemplary embodiment, the shield distance 228 may be controlled or selected, such as by selecting the diameter 200 of the first conductor 110 and selecting the diameter 223 of the first insulator 114.

In the illustrated embodiment, the void 140 is positioned along the first segment 240, such as at a section between the second side 236 and the outer end 232. The elevated segment 142 is thus defined along the first segment 240. The cable shield 120 engages the first insulator outer surface 222 on both sides of the elevated segment 142. The flap 134 wraps around a portion of the first insulator 114, such as from the elevated segment 142 to the outer edge 132. Optionally, the outer edge 132 may be located along the first segment 240, such as approximately aligned with the first side 234. The flap 134 provides electrical shielding at the inner edge 130.

The void 140 affects the electrical characteristics of the signals transmitted by the first conductor 110. For example, the void 140 decreases capacitance of the first conductor by introducing air in the shield space, which has a lower dielectric constant than the dielectric material of the first insulator 114. The decrease in capacitance affects the delay, and thus the speed of the signals transmitted by the first conductor 110, which has a skew effect on the signals transmitted by the first conductor 110, relative to the signals transmitted by the second conductor 112. For example, the skew may be affected by having the signals travel faster in the first conductor 110 compared to a hypothetical situation in which no void 140 were present. Thus, the void 140 leads to skew problems in the conductor assembly 102.

The first conductor 110 and/or the first insulator 114 may be modified (for example, compared to the second conductor 112 and/or the second insulator 116) to balance or correct for the skew imbalance, such as to improve the skew imbalance. The first insulator 110 and/or the first insulator 114 may be modified to allow for a zero skew or near-zero skew in the conductor assembly 102. In various embodiments, the positioning of the outer surface 202 relative to the cable shield 120 is different (for example, positioned further apart) than the distance between the second conductor 112 and the cable shield 120. Changing one or both of the diameters 200, 223 changes the thickness 224, which corresponds to the shield distance 228 between the first conductor 110 and the cable shield 120, which affects the skew and may be used to balance the skew compared to the second conductor 112. In various embodiments, the diameter 200 of the first conductor 110 is reduced (for example, compared to the second conductor 112) to slow the signal transmission in the first conductor 110 to balance the skew. In various embodiments, the diameter 223 of the first insulator 114 is increased (for example, compared to the second insulator 116) to slow the signal transmission in the first conductor 110 to balance skew. In various embodiments, both diameters 200, 223 may be different than the corresponding diameters of the second conductor 112 and the second insulator 116. In other embodiments, only one of the diameters 200, 223 is different than the corresponding diameters of the second conductor 112 and the second insulator 116. Changing one or both of the diameters 200, 223, compared to the corresponding diameters of the second conductor 112 and/or the second insulator 116, creates an asymmetry in the conductor assembly 102.

In an exemplary embodiment, the first conductor 110 is modified compared to the second conductor 112 to balance or correct for the skew imbalance, such as to improve the skew imbalance. The first conductor 110 is modified to allow for a zero skew or near-zero skew in the conductor assembly 102. In various embodiments, the diameter 200 of the first conductor 110 is decreased compared to the second conductor 112 to create a proportional increase in the inductance in the first conductor 110 to compensate for the decrease in capacitance and keep the delay similar to the second conductor 112 and eliminate skew. The decrease in the diameter 200 of the first conductor 110 is used to balance the delay per unit length compared to the second conductor 112. The first diameter 200 is selected to balance skew effects of the void 140 on the first conductor 110 compared to the second conductor 112 along the length of the electrical cable 100. Even though the first and second sides have different capacitances, due to the void 140 only being present on the first side and absent on the second side, the first and second sides have different inductances, due to the different diameters of the first and second conductors 110, 112, leading to a balanced speed of the signals in the first and second conductors 110, 112 to have a zero or near-zero skew imbalance along the length of the electrical cable 100. While the effects are described with reference to a decrease in the diameter of the first conductor 110, a similar result may be achieved by increasing the diameter of the second conductor 112.

In an exemplary embodiment, the first insulator 114 is modified compared to the second insulator 116 to balance or correct for the skew imbalance, such as to improve the skew imbalance. The first insulator 114 is modified to allow for a zero skew or near-zero skew in the conductor assembly 102. In various embodiments, the diameter 223 of the first insulator 114 is increased compared to the second insulator 116 to create a proportional increase in the inductance in the first conductor 110 to compensate for the decrease in capacitance due to the void 140 and keep the delay similar to the second conductor 112 and eliminate skew. The increase in the diameter 223 of the first insulator 114 is used to balance the delay per unit length compared to the second conductor 112. The first diameter 223 is selected to balance skew effects of the void 140 on the first conductor 110 compared to the second conductor 112 along the length of the electrical cable 100. Even though the air void only affects the first side of the electrical cable 100, the inductance is increased may be proportioned to compensate for the decrease in capacitance due to the air void 140. The balancing leads to a balanced speed of the signals in the first and second conductors 110, 112 to have a zero or near-zero skew imbalance along the length of the electrical cable 100. While the effects are described with reference to an increase in the thickness 224 of the first insulator 114, a similar result may be achieved by decreasing the diameter/thickness of the second insulator 116.

In an exemplary embodiment, the second conductor 112 has a second conductor outer surface 302 having a circular cross-section having a second diameter 300. In various embodiments, the first and second conductors 110, 112 are the same gauge conductors 110, 112 such that the second diameter 300 is equal to the first diameter 200. In other various embodiments, the second diameter 300 may be larger than the first diameter 200 of the first conductor 110. The second conductor 112 has an inner end 310 facing the inner end 210 of the first conductor 110 and an outer end 312 opposite the inner end 310. The second conductor 112 has a first side 314 (for example, a top side) and a second side 316 (for example, a bottom side) opposite the first side 314. The first and second sides 314, 316 are equidistant from the inner and outer ends 310, 312.

In an exemplary embodiment, the second insulator 116 has a circular cross-section surrounding the second conductor 112. The second insulator 116 has a second radius 320 to a second insulator outer surface 322 and a second diameter 323. In an exemplary embodiment, the second radius 320 is smaller than the first radius 220; however, the second radius 320 may be equal to or larger than the first radius 220 in alternative embodiments. The second insulator 116 has a second thickness 324 between a second insulator inner surface 326 and the second insulator outer surface 322. The thickness 324 defines a second distance or shield distance 328 between the second conductor 112 and the cable shield 120. The second insulator inner surface 326 engages the second conductor outer surface 302. The second insulator outer surface 322 engages the first insulator 114 at the seam 150. The second insulator 116 has an inner end 330 facing the first insulator 114 and an outer end 332 opposite the inner end 330. The second insulator 116 has a first side 334 (for example, a top side) and a second side 336 (for example, a bottom side) opposite the first side 334. The first and second sides 334, 336 are equidistant from the inner and outer ends 330, 332.

The cable shield 120 engages the second insulator outer surface 322 along a second segment 340. For example, the second segment 340 may extend from approximately the first side 334 to approximately the second side 336 while passing the outer end 332. The second segment 340 may encompass approximately half of the outer circumference of the second insulator outer surface 322. In an exemplary embodiment, the first and second insulators 114, 116 are lemniscate and thus define a first pocket 350 and a second pocket 352 within the cable core inside of the interior 126 of the cable shield 120. In an exemplary embodiment, the first and second pockets 350, 352 are generally symmetrical, and thus do not have an appreciable affect on skew imbalance for the first or second conductors 110, 112. The conductors 110, 112 are more closely coupled to the cable shield 120 along the first and second segments 240, 340, respectively. Thus, the portion of the cable shield 120 beyond the first and second insulator outer surfaces 222, 322 across the pockets 350, 352 does not affect skew, but rather the interaction between the conductors 110, 112 and the cable shield 120 along the first and second segments 240, 340 control the skew performance.

The shield distance 328 between the cable shield 120 and the second conductor 112 is defined by the thickness 324 of the second insulator 116 between the inner surface 326 and the outer surface 322. The shield distance 328 affects the electrical characteristics of the signals transmitted by the second conductor 112. For example, the shield distance 328 affects the inductance and the capacitance of the second conductor 112, which affects the delay or skew of the signal, the insertion loss of the signal, the return loss of the signal, and the like. In an exemplary embodiment, the shield distance 328 may be controlled or selected, such as by selecting the diameter 300 of the second conductor 112 and selecting the diameter 323 of the second insulator 116.

In the illustrated embodiment, the second segment 340 does not include any void like the void 140. The second conductor 112 is thus not subjected to the same delay change as the first conductor 110 from the void 140. When comparing the first and second conductors 110, 112, the void 140 creates a skew imbalance between the first and second conductors 110, 112 by decreasing capacitance of the first conductor 110 as compared to the second conductor 112, which affects the velocity or speed of the signal transmission through the first conductor 110 as compared to the second conductor 112. However, the first conductor 110 and/or the first insulator 114 may be modified to compensate for the void 140.

In an exemplary embodiment, the first conductor 110 may have a smaller diameter 200 than the diameter 300 of the second conductor 112, which increases inductance of the first conductor 110 as compared to the second conductor 112, which affects the velocity or speed of the signal transmission through the first conductor 110 as compared to the second conductor 112. In an exemplary embodiment, for the first conductor 110, the decrease in capacitance is compensated for by a proportional increase in inductance, thus keeping the delay (square root of inductance times capacitance) similar or the same leading to zero or near-zero skew. The asymmetrically designed conductors 110, 112 (for example, smaller diameter first conductor 110 and larger diameter second conductor 112) compensates for the void 140. In an exemplary embodiment, the first diameter 200 is selected based on the size of the void 140 and the volume of air introduced along the first conductor 110 compared to the second conductor 112 along the length of the electrical cable 100. For example, the shape and shape of the void 140 controls the volume of air introduced in the shield area, and thus the amount of decrease in capacitance. The thickness of the cable shield 120 at the inner edge 130 affects the size and shape of the void 140, such as by affecting the height and the width of the void 140. In the illustrated embodiment, the void 140 is generally triangular shaped having a maximum height at the inner edge 130 and tapering down toward zero height at the lift off point of the elevated segment 142. The volume of the void 140 creates a decrease in capacitance of the first conductor 110 compared to the second conductor 112 and the diameter difference between the first diameter 200 and the second diameter 300 creates an increase in inductance in the first conductor 110 compared to the second conductor 112. The increase in inductance is proportional to the decrease in capacitance to balance skew effects. In an exemplary embodiment, the increase in inductance is equal to the decrease in capacitance leading to skew balance. In an exemplary embodiment, the void 140 creates a first skew imbalance and reducing the diameter 200 of the first conductor 110 compared to the diameter 300 of the second conductor 112 creates a second skew imbalance opposing the first skew imbalance, such as to create a zero skew or a near-zero skew situation.

In other various embodiments, the first insulator 114 may have a larger diameter 223 and/or a greater thickness 224 as compared to the second insulator 116, which increases inductance of the first conductor 110 as compared to the second conductor 112, which affects the velocity or speed of the signal transmission through the first conductor 110 as compared to the second conductor 112. In an exemplary embodiment, for the first conductor 110, the decrease in capacitance is compensated for by a proportional increase in inductance due to the larger first insulator 114, thus keeping the delay (square root of inductance times capacitance) similar or the same leading to zero or near-zero skew. The asymmetrically designed insulators 114, 116 (for example, larger diameter/thicker first insulator 114 compared to the second insulator 116) compensates for the void 140. In an exemplary embodiment, the first diameter 223 is selected based on the size of the void 140 and the volume of air introduced along the first conductor 110 compared to the second conductor 112 along the length of the electrical cable 100. For example, the shape and shape of the void 140 controls the volume of air introduced in the shield area, and thus the amount of decrease in capacitance. The thickness of the cable shield 120 at the inner edge 130 affects the size and shape of the void 140, such as by affecting the height and the width of the void 140. In the illustrated embodiment, the void 140 is generally triangular shaped having a maximum height at the inner edge 130 and tapering down toward zero height at the lift off point of the elevated segment 142. The volume of the void 140 creates a decrease in capacitance of the first conductor 110 compared to the second conductor 112 and the diameter difference between the first diameter 223 and the second diameter 323 creates an increase in inductance in the first conductor 110 compared to the second conductor 112. The diameter difference may equate to a greater thickness 224 (as compared to the thickness 324) of the dielectric material surrounding the first conductor 110, which affects the inductance. The larger diameter 223 may equate to an increase in the shield distance 228 (as compared to the shield distance 328), which affects the inductance. The increase in inductance due to the larger insulator 114 is proportional to the decrease in capacitance due to the air void 140, which leads to a net zero or near net zero change in delay compared to the second conductor 112 to balance skew effects. In an exemplary embodiment, the increase in inductance is equal to the decrease in capacitance leading to skew balance. In an exemplary embodiment, the void 140 creates a first skew imbalance and increasing the diameter 223 of the first insulator 114 compared to the diameter 323 of the second insulator 116 creates a second skew imbalance opposing the first skew imbalance, such as to create a zero skew or a near-zero skew situation.

Figure 3:
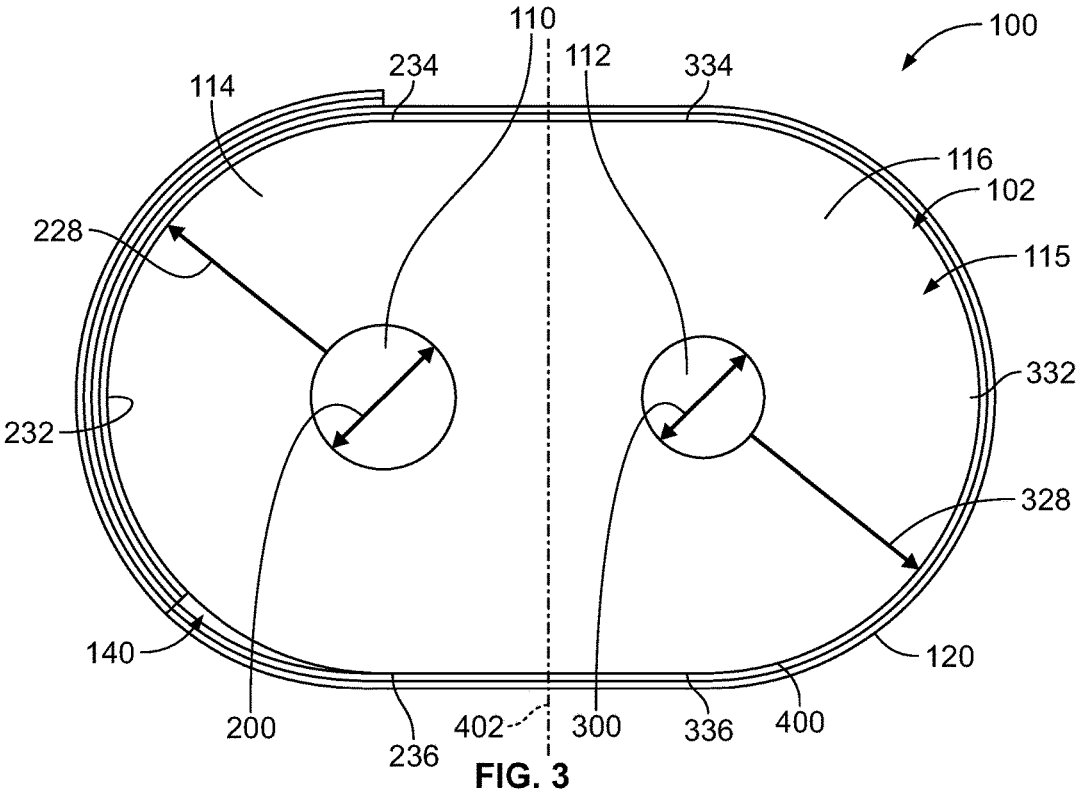
FIG. 3 is a cross-sectional view of the conductor assembly according to another exemplary embodiment.

FIG. 3 is a cross-sectional view of the conductor assembly 102 according to another exemplary embodiment. In the alternative embodiment shown in FIG. 3, the insulator structure 115 is one integral member that surrounds and extends between the first and second conductors 110, 112. For example, the conductor assembly 102 may be formed by molding, extruding or otherwise applying the material of the insulator structure 115 to the first and second conductors 110, 112 at the same time. The conductor assembly 102 forms a twin-axial insulated wire, and the cable shield 120 is subsequently applied around the twin-axial insulated wire. In FIG. 3, the outer perimeter of the insulator structure 115 may have a generally elliptical or oval shape. However, one side of the insulator structure 115 may be slightly larger (for example, wider, thicker, and the like) than the other side to compensate for the air void 140. It is recognized that the insulator structure 115 need not have the elliptical shape in other embodiments.

The cable shield 120 generally conforms to the insulator structure 115, except at the void 140. In an embodiment, the cross-sectional shape of the cable shield 120 is geometrically similar to the cross-sectional shape of the outer perimeter of the insulator structure 115. The term "geometrically similar" is used to mean that two objects have the same shape, although different sizes, such that one object is scaled relative to the other object. As shown in FIG. 3, the outer perimeter of the cable shield 120 has a generally elliptical or oval shape along the cross-section, which is similar to the outer perimeter of the insulator structure 115.

The insulator structure 115 has an outer surface 400. The cable shield 120 is applied to the outer surface 400. The material of the insulator structure closer to the first conductor 110 insulates the first conductor 110 from the second conductor 112 and from the cable shield 120 and thus defines a first insulator 114. The material of the insulator structure closer to the second conductor 112 insulates the second conductor 112 from the first conductor 110 and from the cable shield 120 and thus defines a second insulator 116. In an exemplary embodiment, the shape of the insulator structure 115 may be asymmetrical about a bisector axis 402 between the first and second conductors 110, 112 due to the oversizing of one side (for example, the first insulator 114) as compared to the other side (for example, the second insulator 116).

The first and second insulators 114, 116 of the insulator structure are defined on opposite sides of the bisector axis 402 centered between the first and second conductors 110, 112. The shield distance 228 between the first conductor 110 and the cable shield 120 is defined along the cupped or rounded side of the conductor assembly 102, such as from the first side 234 to the second side 236 through the outer end 232. The shield distance 328 between the second conductor 112 and the cable shield 120 is defined along the cupped or rounded side of the conductor assembly 102, such as from the first side 334 to the second side 336 through the outer end 332.

In an exemplary embodiment, the first shield distance 228 and the second shield distance 328 are selected to be different to balance skew effects of the air void 140 on the first conductor 110 compared to the second conductor 112 along the length of the electrical cable 100. For example, the first shield distance 228 is greater than the second shield distance 328 to slow the velocity of the signals in the first conductor 110 compared to the second conductor 112. In an exemplary embodiment, the first shield distance 228 is selected based on the size of the air void 140 and the volume of air introduced along the first conductor 110 compared to the second conductor 112 along the length of the electrical cable 110. In an exemplary embodiment, the air void 140 creates a first skew imbalance and positioning of the first conductor 110 further from the cable shield 120 (or the second conductor 112 closer to the cable shield 120) creates a second skew imbalance opposing the first skew imbalance, such as to create a zero skew or a near-zero skew situation. The first conductor 110 may be positioned further from the cable shield 120 by having different sized conductors 110, 112 (for example, making the first conductor 110 smaller) and/or by having different sized insulators 114, 116 (for example, making the first insulator 114 larger).

In various embodiments, the first conductor 110 has the first diameter 200 and the second conductor 112 has the second diameter 300. In various embodiments, the first diameter 200 is smaller than the second diameter 300 to compensate for the air void 140 and balance skew effects of the void 140 on the first conductor 110 compared to the second conductor 112 along the length of the electrical cable 100. The diameter 200 of the first conductor 110 is decreased compared to the second conductor 112 to create a proportional increase in the inductance in the first conductor 110 to compensate for the decrease in capacitance and keep the delay similar to the second conductor 112 and eliminate skew. The decrease in the diameter 200 of the first conductor 110 is used to balance the skew compared to the second conductor 112. Even though the first and second sides have different capacitances, due to the void 140 only be present on the first side and absent on the second side, the first and second sides have different inductances, due to the different diameters of the first and second conductors 110, 112, leading to a balanced speed of the signals in the first and second conductors 110, 112 to have a zero or near-zero skew imbalance along the length of the electrical cable 100.

In other various embodiments, the first insulator 114 is larger than the second insulator 116 to compensate for the air void 140 and balance skew effects of the void 140 on the first conductor 110 compared to the second conductor 112 along the length of the electrical cable 100. For example, the first insulator 114 may have a greater thickness as compared to the second insulator 116. The thickness of the first insulator 114 is increased compared to the second insulator 116 to create a proportional increase in the inductance in the first conductor 110 to compensate for the decrease in capacitance due to the air void 140 and keep the delay similar to the second conductor 112 and eliminate skew. The increase in the thickness of the first insulator 114 may correspond to an increase in the shield distance between the first conductor 110 and the cable shield 120 as compared to the second conductor 112. The increased thickness/increase in shield distance is used to balance the skew compared to the second conductor 112 such as to have a balanced speed of the signals in the first and second conductors 110, 112 to have a zero or near-zero skew imbalance along the length of the electrical cable 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical cable comprising:

a conductor assembly having a first conductor, a second conductor, a first insulator surrounding the first conductor and a second insulator surrounding the second conductor, the first and second conductors carrying differential signals, the first insulator having an outer surface, the first insulator having a first thickness between the first conductor and the outer surface of the first insulator, the second insulator having an outer surface, the second insulator having a second thickness between the second conductor and the outer surface of the second insulator, the first thickness being greater than the second thickness; and a cable shield wrapped around the conductor assembly and engaging the outer surface of the first insulator along a first segment and engaging the outer surface of the second insulator along a second segment, the cable shield having an inner edge and a flap covering the inner edge, the cable shield forming a void at the inner edge, the void being located closer to the first conductor than the second conductor.

2. The electrical cable of claim 1, wherein the first conductor is located a first shield distance from the cable shield corresponding to the first thickness and the second conductor is located a second shield distance from the cable shield corresponding to the second thickness, the first shield distance being greater than the second shield distance.

3. The electrical cable of claim 1, wherein a difference between the first thickness and the second thickness is selected to balance skew effects of the void on the first conductor compared to the second conductor along the length of the electrical cable.

4. The electrical cable of claim 1, wherein the void has a volume creating a decrease in capacitance of the first conductor compared to the second conductor, the thickness difference between the first thickness and the second thickness creating an increase in inductance in the first conductor compared to the second conductor, wherein the increase in inductance is proportional to the decrease in capacitance to balance skew effects.

5. The electrical cable of claim 1, wherein the first insulator has a first diameter at the outer surface of the first insulator and the second insulator has a second diameter at the outer surface of the second insulator, the first diameter being larger than the second diameter.

6. The electrical cable of claim 1, wherein the first conductor and the second conductor have equal diameters.

7. The electrical cable of claim 1, wherein the first conductor and the second conductor have different first and second diameters, respectively.

8. The electrical cable of claim 1, wherein the first and second insulators are asymmetrical.

9. An electrical cable comprising:

a conductor assembly having a first conductor, a second conductor, and an insulator structure surrounding the first conductor and the second conductor, the first and second conductors carrying differential signals, the insulator structure having an outer surface; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor;

wherein the first conductor is located a first shield distance from the cable shield and the second conductor is located a second shield distance from the cable shield, the first shield distance being greater than the second shield distance.

10. The electrical cable of claim 9, wherein the insulator structure includes a first insulator surrounding the first conductor and a second insulator surrounding the second conductor, the first insulator having a first thickness between the first conductor and the outer surface of the first insulator and the second insulator having a second thickness between the second conductor and the outer surface of the second insulator, the first thickness being greater than the second thickness.

11. The electrical cable of claim 9, wherein the first shield distance is selected to balance skew effects of the void on the first conductor compared to the second conductor along the length of the electrical cable.

12. The electrical cable of claim 9, wherein the first distance is selected based on the size of the air void and the volume of air introduced along the first conductor compared to the second conductor along the length of the electrical cable.

13. The electrical cable of claim 9, wherein the void has a volume creating a decrease in capacitance of the first conductor compared to the second conductor, the shield distance difference between the first shield distance and the second shield distance creating an increase in inductance in the first conductor compared to the second conductor, wherein the increase in inductance is proportional to the decrease in capacitance to balance skew effects.

14. The electrical cable of claim 9, wherein the insulator structure includes a first insulator surrounding the first conductor and a second insulator surrounding the second conductor, the first insulator having a first diameter at the outer surface of the first insulator and the second insulator having a second diameter at the outer surface of the second insulator, the first diameter being larger than the second diameter.

15. The electrical cable of claim 9, wherein the first conductor and the second conductor have equal diameters.

16. The electrical cable of claim 9, wherein the insulator structure is asymmetrical about a transverse axis between the first and second conductors.

17. An electrical cable comprising:

a conductor assembly having a first conductor, a second conductor, a first insulator surrounding the first conductor and a second insulator surrounding the second conductor, the first and second conductors carrying differential signals, the first insulator having an outer surface, the first insulator having a first diameter at the outer surface, the second insulator having an outer surface, the second insulator having a second diameter at the outer surface, the first diameter being larger than the second diameter; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor, the void having a volume creating a decrease in capacitance of the first conductor compared to the second conductor;

wherein the first insulator is sized larger than the second insulator creating an increase in inductance in the first conductor compared to the second conductor, wherein the increase in inductance due to the larger first diameter is proportional to the decrease in capacitance due to the void to balance skew effects.

18. The electrical cable of claim 17, wherein the first insulator has a first thickness between the first conductor and the outer surface of the first insulator and the second insulator has a second thickness between the second conductor and the outer surface of the second insulator, the first thickness being greater than the second thickness.

19. The electrical cable of claim 17, wherein the first conductor is located a first shield distance from the cable shield and the second conductor is located a second shield distance from the cable shield, the first shield distance being greater than the second shield distance.

20. The electrical cable of claim 17, wherein the first conductor and the second conductor have equal diameters.

* * * * *